United States Patent [19]

Watanabe

[11] Patent Number: 4,962,080

[45] Date of Patent: Oct. 9, 1990

[54] IMAGE-RECEIVING SHEET FOR THERMAL DYE-TRANSFER RECORDING

[75] Inventor: Kazuo Watanabe, Hyogo, Japan

[73] Assignee: Kanzaki Paper MFG. Co., Ltd., Tokyo, Japan

[21] Appl. No.: 319,203

[22] Filed: Mar. 6, 1989

[30] Foreign Application Priority Data

Mar. 8, 1988 [JP] Japan ..... 63-55451
Nov. 2, 1988 [JP] Japan ..... 63-278176

[51] Int. Cl.[5] ..... B41M 5/035; B41M 5/26

[52] U.S. Cl. ..... 503/227; 8/471; 428/195; 428/327; 428/331; 428/447; 428/913; 428/914

[58] Field of Search ..... 8/471; 428/195, 327, 428/331, 413, 423.1, 447, 475.5, 480, 522, 913, 914; 503/227

[56] References Cited

U.S. PATENT DOCUMENTS 3,601,484 8/1971 Dybvig et al. ..... 355/4

FOREIGN PATENT DOCUMENTS 0261970 3/1988 European Pat. Off. ..... 503/227
57-107885 7/1982 Japan ..... 503/227
60-212394 10/1985 Japan ..... 503/227
1199997 9/1986 Japan ..... 503/227
3074691 4/1988 Japan ..... 503/227

*Primary Examiner*—Bruce H. Hess
*Attorney, Agent, or Firm*—Finnegan, Henderson, Farabow, Garrett and Dunner

[57] ABSTRACT

An image-receiving sheet for thermal dye-transfer recording is disclosed, which comprises a support having thereon an image-receiving layer for receiving a transferred image from a coloring material-transferring sheet, wherein said image-receiving layer is an image-receiving layer formed by coating an aqueous coating composition comprising a dyeable resin, an alcoholic hydroxyl group-containing alcohol-modified silicone oil, and colloidal silica and/or an aqueous crosslinking agent in an aqueous medium, followed by drying.

The image-receiving sheet of the invention is excellent in recording sensitivity, remarkably improved in terms of storage stability of recorded images, and excellent in productivity.

20 Claims, No Drawings

IMAGE-RECEIVING SHEET FOR THERMAL DYE-TRANSFER RECORDING

FIELD OF THE INVENTION

This invention relates to an image-receiving sheet for thermal dye-transfer recording using a heat-sublimable dye, particularly full color recording. More particularly, it relates to an image-receiving sheet which is excellent in recording sensitivity and productivity and provides a recorded image having markedly improved storage stability.

BACKGROUND OF THE INVENTION

A thermal recording system for obtaining recorded images simultaneously with application of input signals is widely used in facsimiles, computer terminal printers, and printers for measuring equipment because the apparatus used in the system is relatively easy to handle and inexpensive and is of low noise.

The recording medium commonly employed in the thermal recording system is a so-called color formation type heat-sensitive recording material having a recording layer which undergoes physical and chemical changes on heating to cause color formation. The recording medium of this type, however, is liable to induce undesired color formation during the production or storage thereof. Moreover, the image formed thereon has poor storage stability. For example, the image undergoes fading when brought into contact with organic solvents or chemicals.

In order to overcome these problems, it has been proposed to use a recording medium utilizing a self-colored coloring material in place of the abovedescribed color formation type heat-sensitive recording medium. For example, JP-A-51-15446 (the term "JP-A" as used herein means an "unexamined published Japanese patent application") discloses a recording system in which a support, such as paper and a polymer film, coated with a coloring material which is solid or semi-solid at room temperature is superposed on a recording material (image-receiving sheet) in such a manner that the coloring material comes into contact with the recording material, and the coloring material is heated with a thermal recording head and selectively transferred to the recording material to obtain a desired image.

According to this recording system, the coloring material on the support is melted, evaporated, and sublimated by the application of heat. It is then transferred to the recording material to form an image through sticking, adsorption, and dye-fixing. One of the admitted characteristics of this recording system is that plain paper (non-coated paper) may be used as the recording material. In particular, a system using a sublimable dye as the coloring material provides an image excellent in image gradation, and hence attempts have been made to apply this system to full color recording.

However, when plain paper is used as the recording material, the dye-fixing, in particular, is difficult to accomplish. As a result, not only is the resulting recorded image low in color density, but serious fading occurs with time. Therefore, it has been suggested to use an image-receiving sheet having an image-receiving layer mainly comprising a thermoplastic resin as described in JP-A-57-107885, JP-A-59-165688, and U.S. Pat. No. 3,601,484.

Although image-receiving layer mainly comprising a thermoplastic resin achieves improvements on recording sensitivity and storage stability to some extent, there still remain some problems to solve. For example, the recorded image fades when irradiated with light, or undesired heat fusion between the image-receiving sheet and the coloring material-transferring layer takes place.

In order to prevent such undesired heat fusion between the image-receiving sheet and the coloring material-transferring layer, it has been recommended to incorporate a release agent into the image-receiving layer as disclosed in JP-A-60-34898 and JP-A-60-212394 or to provide a release layer on the image-receiving layer as disclosed in JP-A-59-165688.

However, an image-receiving sheet containing liquid or semi-solid silicon compounds, fluorine compounds, waxes, higher fatty acids, or higher fatty acid salts as the release agent exhibits deteriorated storage stability after image formation so that the image would undergo bleeding. When, in particular, a plurality of coloring material-transferring sheets having different colors, such as yellow, red, blue, and black, are successively used for obtaining a color image, the resulting image is poor in color reproduction, or undesired heat fusion between the image-receiving sheet and the coloring mateial-transferring layer is apt to occur as the recording is successively carried out. In cases where reaction-curable silicon compounds are used as the release agent, the image-receiving layer coated with the release agent should be subjected to curing by heating or irradiation of actinic energy rays, thus giving rise to a problem of low productivity. In addition, use of these release agents reduces recording sensitivity.

SUMMARY OF THE INVENTION

One object of this invention is to provide an image-receiving sheet for thermal dye-transfer recording, in which a self-colored coloring material, particularly a heat-sublimable dye is thermally transferred, which exhibits excellent recording sensitivity to provide a very sharp recorded image having a high color density.

Another object of this invention is to provide an image-receiving sheet for thermal dye-transfer recording which exhibits satisfactory color reproducibility even when used for multi-color recording.

A further object of this invention is to provide an image-receiving sheet for thermal dye-transfer recording which does not suffer from undesired heat fusion with a coloring mateial-transferring layer.

A still further object of this invention is to provide an image-receiving sheet for thermal dye-transfer recording which can be produced by using an aqueous coating composition without requiring curing treatment thereby assuring safety and high productivity.

A yet further object of this invention is to provide an image-receiving sheet for thermal dye-transfer recording which provides a recorded image excellent in storage stability.

The inventor has conducted extensive investigations and, as a result, it has now been found that the above objects of this invention can be accomplished by forming an image-receiving layer of an image-receiving sheet with a specific aqueous coating composition. The present invention has been completed based on this finding.

The present invention provides an image-receiving sheet for thermal dye-transfer recording, which comprises a support having thereon an image-receiving layer for receiving a transferred image from a coloring material-transferring sheet, wherein said image-receiving layer is an image-receiving layer formed by coating an aqueous coating composition comprising a dyeable resin, an alcoholic hydroxyl group-containing alcohol-modified silicone oil, and colloidal silica and/or an aqueous crosslinking agent in an aqueous medium, followed by drying.

DETAILED DESCRIPTION OF THE INVENTION

The dyeable resin which can be used as a main component constituting the image-receiving layer of the image-receiving sheet according to the present invention is a water-soluble or water-dispersible thermoplastic resin and includes, for example, polyesters, polystyrene, polyurethane, vinyl acetate copolymers, acrylic copolymers, epoxy resins, acetate resins, and nylon resins.

Specific examples of the dyeable resin include a series of Plascoat® Z (a trade name, produced by Go-oh Kagaku Co., Ltd.), a series of Polyester WR (a trade name, produced by The Nippon Synthetic Chemical Industry Co., Ltd.), a series of Vylonal® (a trade name, produced by Toyobo Co., Ltd.), a series of Hydran® AP, Hydran® HW, Finetex® ES, and Grandoll® (trade names, produced by Dainippon Ink and Chemicals, Inc.), a series of Pesresin® (a trade name, produced by Takamatsu Oil & Fat Corp.), and a series of Eastman® WNT-SIZE (a trade name, produced by Eastman Kodak Company). Preferred of them are those having a glass transition temperature (Tg) ranging from 40° to 130° C., more preferably from 60 to 110° C. Resins having a Tg of less than 40° C. tend to cause heat bleeding, which leads to blur of a dye image. Resins having a Tg exceeding 130 ° C. exhibit reduced sensitivity.

The alcohol-modified silicone oil which can be used in the present invention is a silicone oil containing an alcoholic hydroxyl group. Such an alcohol-modified silicone oil can be represented, for example, by structural formulae (1) and (2):

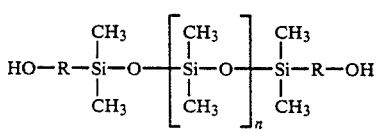

(1)

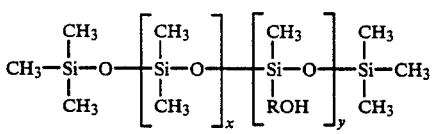

(2)

wherein R represents an alkylene group containing frOm 1 to 10 carbon atoms; and n and the sum of x and y each usually ranges from 4 to 1000.

The alcohol-modified silicone oil preferably has a molecular weight of from about 500 to 50,000.

Specific examples of the alcohol-modified silicone oil are (A) those which fall within structural formula (1), such as BY16-848, BX16-848B, BX16-001, BX16-002, BX16-003, BX16-004, BX16-005, BX16-006, BX16- 007, BX16-008, BX16-009, BX16-010, BX16-011, BX16-012, and SF8427 (trade names, produced by Toray Silicone Co., Ltd.), and X-22-160AS, X-22-160A, X-22-160B, and X-22-160C (trade names, produced by Shin-Etsu Chemical Co., Ltd.); and (B) those which fall within structural formula (2), such as SF8428, SH3771, SH3746, BY11-954, BY16-036, BY16-027, BY16-038, and BX16-018 (trade names, produced by Toray Silicone Co., Ltd.). Particularly preferred of them is SF-8427 because of its water-solubility. The water-insoluble oils can be used in the form of an emulsion.

The alcohol-modified silicone oil is used in an amount of from 3 to 20%, preferably from 5 to 15%, by weight based on the total solids content of the imagereceiving layer.

The colloidal silica which can be used in the present invention is an anhydrous silicate having a particle size of from 1 to 100 mμ. On the surface of the particles are present an —SiOH group and an —OH⁻, ion, and the alkali ions form electrical double layers, by which particles are mutually repulsed and stabilized.

Specific examples of such colloidal silica include a series of Adelite® AT (a trade name, produced by Asahi Denka Kogyo K.K.) and a series of Snowtex® (a trade name, produced by Nissan Chemical Industries, Ltd.). The colloidal silica is used in an amount of from about 3 to 50%, preferably from about 5 to 30%, by weight based on the dyeable resin.

The functional mechanism of the colloidal silica in prevention of undesired heat fusion between the image-receiving sheet and the coloring material-transferring layer without requiring curing of a release agent has not yet been elucidated, but it is probable that the —SiOH group and —OH⁻ion present on the surface of colloidal silica particles and the alcoholic hydroxyl group of the alcohol-modified silicone oil undergo crosslinking reaction to inhibit heat fusion.

The aqueous crosslinking agent which can be used in the present invention is a water-soluble or water-dispersible crosslinking agent and includes, for example, aminoplast resins, melamine resins, epoxy resins, aziridine resins, and isocyanate resins.

The aqueous crosslinking agent is added to the coating composition for an image-receiving layer in an amount of from about 0.5 to 10%, preferably from about 1 to 5%, by weight based on the dyeable resin. It is made to react by the action of heat during drying of the coating composition or the subsequent working-up step. If desired, a catalyst for accelerating the crosslinking reaction may be used in combination.

In the present invention, for the purpose of rendering the surface of the image-receiving sheet matte, dyeable vinyl polymer fine particles can be used. Such vinyl polymer fine particles include fine particles of polymers mainly comprising a vinyl monomer, e.g., styrene, α-methylstyrene, 4-methylstyrene, 2-methylstyrene, 4-methoxystyrene, vinyl chloride, vinylidene chloride, ethylene, vinylcyclohexane, methyl methacrylate, ethyl methacrylate, methyl acrylate, hexyl acrylate, vinyl acetate, and acrylonitrile. Preferred of them are those mainly comprising polystyrene.

The particle size of these dyeable vinyl polymer particles is appropriately selected depending on the end use of the image-receiving sheet. In general, it is controlled within a range of from 0.01 to 10 μm, preferably from 0.05 to 5 μm. In particular, polymer fine particles having a particle size of from 0.3 to 5 μm are the most preferred, providing an image-receiving sheet having a matte surface.

The above-described polymer particles in the form of an aqueous dispersion are coated and then dried. In order to attain desired effects, it is necessary to coat and dry the aqueous dispersion of the polymer particles while keeping the finely dispersed state without completely forming a film.

An image-receiving sheet having a matte surface and high recording sensitivity can be obtained by using the polymer fine particles preferably in an amount of from about 5 to 30%, more preferably from about 10 to 25%, by weight based on the dyeable resin. If the content of the polymer particles is less than 5% by weight, a matte surface cannot be obtained. If it exceeds 30% by weight, unnecessary heat fusion between the image-receiving layer and the coloring material-transferring layer occurs, failing to obtain a clear image.

If desired, for the purpose of improving writing properties of the image-receiving sheet, the coating composition for the image-receiving layer may further contain organic or inorganic;,pigments, such as natural ground calcium carbonate, precipitated calcium carbonate, talc, clay, titanium oxide, aluminum hydroxide, zinc oxide, and a urea-formaldehyde resin powder. For the purpose of modifying the image-receiving layer or endowing the image-receiving layer with other functions, the composition may furthermore contain various additives, such as ultraviolet absorbents, antioxidants, antistatic agents, and lubricants; or hardening agents for the image-receiving layer. Other synthetic resins may also be used in combination so long as they do not impair characteristics of the present invention.

The coverage of the coating composition for the image-receiving layer is appropriately selected depending on the end use and usually ranges from about 4 to 15 $g/m^2$.

The support of the image-receiving sheet of the present invention is appropriately selected from, for example, plain paper, synthetic paper, synthetic resin films, and so on. Preferred of them is plain paper because of its excellent thermal properties. Implicit in the plain paper herein referred to are not only paper produced from cellulose pulp, as a main component, containing paper strengthening agents, sizing agents, fixing agents, organic or inorganic fillers, and other additives by an ordinary paper-making process; but paper produced by further treating the thus obtained plain paper to improve surface physical properties, for example, by size pressing with oxidized starch or providing a prime coat mainly comprising a pigment (e.g., clay). Of these paper supports, preferred are papers having excellent surface smoothness, such as art paper, coated paper, and cast-coated paper. Also preferable are papers having provided thereon a rubbery elastic layer comprising a synthetic rubber latex or a microporous layer comprising a foaming agent or hollow microcapsules to thereby improve adhesion or heat transfer efficiency.

The image-receiving sheet for thermal dye-transfer recording according to the present invention exhibits markedly excellent performance, particularly when combined with a coloring material-transferring sheet containing a heat-sublimable dye. That is, the image-receiving sheet shows high recording sensitivity to provide a very sharp image having high color density. The image-receiving sheet does not suffer from undesired heat fusion with the coloring mateial-transferring layer. The image-receiving sheet can be produced by using an aqueous coating composition and is therefore advantageous in productivity. In addition, the image recorded on the image-receiving sheet exhibits excellent storage stability.

The term "heat-sublimable dye" as herein referred to means a coloring material (dye) which is not transferred even in contact with the image-receiving sheet under the usual handling conditions but, when heated to 60° C. or higher, is transferred to the image-receiving sheet through melting, evaporation, and sublimation. Such a heat-sublimable dye is selected appropriately from disperse dyes exemplified by azo dyes, nitro dyes, anthraquinone dyes, and quinoline dyes, basic dyes exemplified by triphenylmethane dyes and fluoran dyes; oil-soluble dyes; and other various types of dyes.

The image-receiving sheet of the present invention is applicable to thermal recording systems, inclusive of not only a contact heating system, in which the sheet is heated with a hot plate or a thermal head of a thermal printing unit, but also a non-contact heating system, in which the sheet is irradiated with heat radiation, e.g., infrared light, a YAG laser, a carbon dioxide laser, etc.

The present invention is now illustrated in greater detail with reference to the following Examples, but it should be understood that the present invention is not deemed to be limited thereto. In these examples, all the percents and parts are given by weight unless otherwise indicated.

EXAMPLE 1

(1) Preparation of Aqueous Coating Composition for Image-Receiving Layer

A hundred parts of an aqueous dyeable resin "Vylonal® MD 1200" a trade name, produced by Toyobo Co., Ltd.; concentration: 34%) were mixed with 3.4 parts of an alcohol-modified silicone oil "SF-8427" (a trade name, produced by Toray Silicone Co., Ltd.) and 17 parts of colloidal silica "Adelite® AT-30A" (a trade name, produced by Asahi Denka Kogyo K.K.; concentration: 30%) under stirring, and then water was added to the mixture so as to have a final concentration of 30%.

(2) Preparation of Image-Receiving Sheet for Thermal Dye-Transfer Recording

An SBR latex was coated on commercially available art paper to an amount of 15 $g/m^2$ (on a dry basis) and dried. The above prepared coating composition was coated on the coated surface of the paper support to an amount of 5 $g/m^2$ (on a dry basis) and dried at 100° C. for 2 minutes to form an image-receiving layer. The coated paper was subjected to smoothing by means of a supercalender composed of a mirror-finished metallic roll and an elastic roll at a linear pressure of 200 kg/cm to obtain an image-receiving sheet for thermal dye-transfer recording.

EXAMPLE 2

An image-receiving sheet for thermal dye-transfer recording was prepared in the same manner as in Example 1, except for using, as the alcohol-modified silicone oil, 17 parts of an emulsion prepared by emulsifying 20 parts of an alcohol-modified silicone oil "X-22-160AS" (a trade name, produced by Shin-Etsu Chemical Co., Ltd.) and 80 parts of polyvinyl alcohol "PVA 217" (a trade name, produced by Kuraray Co., Ltd.; concentration: 2.5%) in a homomixer.

EXAMPLE 3

An image-receiving sheet for thermal dye-transfer recording was prepared in the same manner as in Example 1, except for using, as the dyeable resin, 136 parts of "Pascoat ® Z-446" (a trade name, produced by Go-oh Kagaku Co., Ltd.; concentration: 25%).

Example 4

An image-receiving sheet for thermal dye-transfer recording was prepared in the same manner as in Example 1, except for using, as the dyeable resin, 170 parts of "Pesresin ® 2000" (a trade name, produced by Takamatsu Oil & Fat Corporation; concentration: 20%).

COMPARATIVE EXAMPLE 1

An image-receiving sheet for thermal dye-transfer recording was prepared in the same manner as in Example 1, except for using neither alcohol-modified silicone oil nor colloidal silica.

COMPARATIVE EXAMPLE 2

An image-receiving sheet for thermal dye-transfer recording was prepared in the same manner as in Example 1, except for using no colloidal silica.

COMPARATIVE EXAMPLE 3

An image-receiving sheet for thermal dye-transfer recording was prepared in the same manner as in Example 1, except for using no alcohol-modified silicone oil.

COMPARATIVE EXAMPLE 4

An image-receiving sheet for thermal dye-transfer recording was prepared in the same manner as in Example 1, except for using, as the alcohol-modified silicone oil, 9 parts of an emulsion of dimethylpolysiloxane "SH 7036" (a trade name, produced by Toray Silicone Co., Ltd.; concentration: 38%).

COMPARATIVE EXAMPLE 5

A coating composition consisting of 100 parts of a silicone resin "KS 705S" (a trade name, produced by Shin-Etsu Chemical Co., Ltd.), 4 parts of a silicone resin curing agent "Silicone Catalyst ® PS" (a trade name, produced by Shin-Etsu Chemical Co., Ltd.), 2 parts of a silicone resin curing accelerator "Silicone Catalyst ® PD" (a trade name, produced by Shin-Etsu Chemical Co., Ltd.), and 100 parts of toluene was coated on the image-receiving layer of the image-receiving sheet for thermal dye-transfer recording as prepared in Comparative Example 1 to an amount of 0.3 g/m$^2$ (on a dry basis) and dried at 100° C. for 2 minutes to prepare an image-receiving sheet for thermal dye-transfer recording.

Each of the image-receiving sheets for thermal dye-transfer recording prepared in Examples 1 to 4 and Comparative Examples 1 to 5 was subjected to quality test according to the following method.

One part of each of a yellow heat-sublimable dye (Disperse Yellow 54), a red heat-sublimable dye (Disperse Red 60), and a blue heat-sublimable dye (Solvent Blue 105), 1.5 parts of ethyl cellulose, 10 parts of isopropyl alcohol, and 5 parts of ethanol were mixed, pulverized, and dispersed in a sand mill to prepare a yellow, red, or blue dye ink, respectively, each having an average dispersed particle size of 1 μm. The yellow, red, and blue dye inks were gravure printed side by side in this order on a non-treated surface of a 6 μm thick polyester film having been subjected to heat resistance-imparting treatment each to a dry coverage of 1 g/m$^2$ to obtain a coloring mateial-transferring sheet for full color recording.

The coloring material-transferring sheet was superposed on the image-receiving sheet for thermal dye-transfer recording in such a manner that the coated sides of the sheets were in contact with each other. Heat was then applied from the back side of the coloring mateial-transferring sheet by means of a thermal head (applied voltage: 12 V; pulse width: varying from 2 to 8 msec by 0.5 msec) to form a thermal dye-transferred image on the image-receiving sheet.

The resulting recorded image and fusion between the image-receiving sheet and the coloring material-transferring sheet during recording were examined and evaluated as follows. The results obtained are shown in Table 1 below.

(1) Fusion:

Thermal dye-transfer recording was carried out using the coloring material-transferring sheet in the order of yellow, red, and blue colors in such a manner that a recorded image of the same pulse width be formed on the same area of the image-receiving sheet. Fusion between the sheets during recording was observed and evaluated according to the following rating system.

A . . . . No fusion was observed throughout the trichromatic recording.

B . . . . Fusion occurred during blue dye transfer.

C . . . . Fusion occurred during red dye transfer.

D . . . . Fusion occurred during yellow dye transfer (2) Image Density:

A black image density obtained by the trichromatic recording was measured by the use of a Macbeth densitometer.

TABLE 1

| No. | Fusion | Black Image Density 3.0 ms | 4.5 ms | 6.0 ms | 7.0 ms | 8.0 ms |
|---|---|---|---|---|---|---|
| Example 1 | A | 0.22 | 0.52 | 1.00 | 1.36 | 1.61 |
| Example 2 | A | 0.19 | 0.52 | 0.99 | 1.31 | 1.62 |
| Example 3 | A | 0.19 | 0.48 | 0.99 | 1.30 | 1.57 |
| Example 4 | A | 0.16 | 0.46 | 0.90 | 1.37 | 1.55 |
| Comparative Example 1 | D | | | unmeasurable* | | |
| Example 2 | B | | | " | | |
| Example 3 | D | | | " | | |
| Example 4 | C | | | " | | |
| Example 5 | A | 0.13 | 0.33 | 0.63 | 0.86 | 1.14 |

Note:
*The densities were unmeasurable due to heat fusion between the image-receiving sheet and the coloring material-transferring layer.

As is apparent from the results of Table 1, the image-receiving sheets for thermal dye-transfer recording according to the present invention exhibit excellent recording suitability and provide images having superior properties.

EXAMPLE 5

In 100 parts of a polyurethane emulsion "Hydran ® AP 40" (a trade name, produced by Dainippon Ink & Chemicals, Inc.; concentration: 22%) was dissolved 1.1 parts of an alcohol-modified silicone oil "SF-8427", and 1.4 parts of a melamine resin crosslinking agent "Beckamine ® PM-N" (a trade name, produced by Dainippon Ink & Chemicals, Inc.; concentration: 80%) was added to the solution to prepare an aqueous coating composition for an image-receiving layer.

The composition was coated on commercially available synthetic paper "Yupo ® FPG 150" (a trade name, produced by Oji Yuka Synthetic Paper Co., Ltd.) to an amount of 6 g/m$^2$ (on a dry basis) and dried to prepare an image-receiving sheet for thermal dye-transfer recording.

EXAMPLE 6

An image-receiving sheet for thermal dye-transfer recording was prepared in the same manner as in Example 5, except for replacing the dyeable resin and aqueous crosslinking agent as used in Example 5 with an aqueous polyester resin "Plascoat Z 446" and a melamine resin "Sumitex® M-3" (a trade name, produced by Sumitomo Chemical Co., Ltd.), respectively.

EXAMPLE 7

An image-receiving sheet for thermal dye-transfer recording was prepared in the same manner as in Example 5, except for replacing the dyeable resin as used in Example 5 with an aqueous polyester resin "Vylonal® MD 1200".

COMPARATIVE EXAMPLE 6

An image-receiving sheet for thermal dye-transfer recording was prepared in the same manner as in Example 5, except that the alcohol-modified silicone oil and aqueous crosslinking agent were not used.

COMPARATIVE EXAMPLE 7

An image-receiving sheet for thermal dye-transfer recording was prepared in the same manner as in Example 5, except for using no aqueous crosslinking agent.

COMPARATIVE EXAMPLE 8

An image-receiving sheet for thermal dye-transfer recording was prepared in the same manner as in Example 5, except for using no alcohol-modified silicone oil.

Each of the image-receiving sheets for thermal dye-transfer recording prepared in Examples 5 to 7 and Comparative Examples 6 to 8 was tested for quality as follows.

One part of a blue heat-sublimable dye (Solvent Blue 105), 1.5 parts of ethyl cellulose, 10 parts of isopropyl alcohol, and 5 parts of ethanol were mixed, pulverized, and dispersed in a sand mill to prepare a blue dye ink having an average dispersed particle size of 1 μm.

The blue dye inks was gravure printed on a non-treated surface of a 6 μm thick polyester film having been subjected to heat resistance-imparting treatment to a dry coverage of 1 g/m$^2$ to obtain a coloring material-transferring sheet.

The coloring material-transferring sheet was superposed on the image-receiving sheet in such a manner that the coated sides of the sheets were in contact with each other. Heat was then applied from the back side of the coloring material-transferring sheet by means of a thermal head (applied voltage: 12 V; pulse width: 2 to 8 msec) to form a thermal dye-transferred image on the image-receiving sheet.

Fusion between the image-receiving sheet and the coloring material-transferring sheet during recording and heat bleeding and light resistance of the recorded image were examined and evaluated as follows.

(a) Fusion:

The degree of fusion between the sheets on heat application during recording was evaluated.

(b) Heat Bleeding:

The recorded image was preserved at 60° C. for 48 hours, and the bleeding of the transferred dye was observed under a 25× magnifier.

(c) Light Resistance of Image:

The recorded image was exposed to light transmitted through a glass plate for 10 days, and image density retention (%) after the exposure was calculated.

Separately, a yellow dye ink and a red dye ink were prepared in the same manner as for the blue dye ink, except for using a yellow heat-sublimable dye (Disperse Yellow 54) and a red heat-sublimable dye (Disperse Red 60), respectively, in place of the blue heat-sublimable dye. A coloring material-transferring sheet for full color recording was prepared in the same manner as described above, except for printing the yellow, red, and blue dye inks on the same film in this order side by side.

The coloring material-transferring sheet was superposed on the image-receiving sheet for thermal dye-transfer recording in such a manner that the coated sides of the sheets were in contact with each other. Heat was then applied from the back side of the coloring material-transferring sheet by means of a thermal head (applied voltage: 12 V; pulse width: 2 to 8 msec) so that the yellow, red, and blue dye inks were successively transferred in this order on the same area of the image-receiving sheet. Suitability for full color recording was evaluated in terms of degree of undesired dye transfer. Further, the maximum density of the resulting black image was measured by means of a Macbeth densitometer.

The rating system for these evaluations are as follows. The results obtained are shown in Table 2 below.

TABLE 2

| Example No. | Fusion | Heat Bleeding | Light Resistance | Suitability for Full Color Recording | Black Image Density |
|---|---|---|---|---|---|
| Example 5 | A | A | A | A | 1.41 |
| Example 6 | A | A | A | A | 1.34 |
| Example 7 | A | A | A | A | 1.35 |
| Comparative Example 6 | C | | impossible to evaluate* | | |
| Example 7 | B | C | A | C | unmeasurable** |
| Example 8 | C | | impossible to evaluate* | | |

Note:
*Evaluations could not be made due to heat fusion between the image-receiving sheet and the coloring mateial-transferring sheet.
Rating System:
**A black image could not be obtained due to the heat fusion.
A . . . Excellent
B . . . Medium
C . . . Poor As is apparent from the results of Table 2, the image-receiving sheets for thermal dye-transfer recording according to the present invention exhibit excellent recording suitability and image quality.

EXAMPLE 8

Two parts of a melamine resin crosslinking agent "Beckamine® PM-N" were mixed with 0.2 part of a catalyst for the melamine resin "Sumitex® Accelertor ACX" (a trade name, produced by Sumitomo Chemical Co., Ltd.), and to the mixture were added 100 parts of a dyeable resin "Vylonal® MD 1200" (concentration: 34%) and 1 part of an alcohol-modified silicone oil "SF-8427", followed by thoroughly stirring. Finally, 30 parts of a dyeable vinyl polymer (polystyrene) "PP-1000" (a trade name, produced by Dainippon Ink & Chemicals Inc.; concentration: 48%; particle size: 0.3 to 0.4 μm; Tg: 104° C.) was added thereto to prepare a coating composition for an image-receiving layer.

The resulting coating composition was coated on commercially available synthetic paper "Yupo ® FPG-150" to an amount of 6 g/m² (on a dry basis) and dried at 90° C. for 5 minutes to prepare an image-receiving sheet for thermal dye-transfer recording.

EXAMPLE 9

An image-receiving sheet for thermal dye-transfer recording was prepared in the same manner as in Example 8, except for using, as a dyeable vinyl polymer, 21 parts of polystyrene "Grandoll ® PP-5390" (a trade name, produced by Dainippon Ink & Chemicals Inc.; concentration: 40.7%; particle size: 0.6 μm; Tg: 104° C.).

EXAMPLE 10

An image-receiving sheet for thermal dye-transfer recording was prepared in the same manner as in Example 8, except for using, as a dyeable vinyl polymer, 34 parts of a styrene-acryl resin "XMRP-100" (a trade name, produced by Mitsui Toatsu Chemicals, Inc ; concentration: 42.3%; particle size: 1.0 μm; Tg: 110° C.).

REFERENCE EXAMPLE 1

An image-receiving sheet for thermal dye-transfer recording was prepared in the same manner as in Example 8, except for using no dyeable vinyl polymer fine particles.

REFERENCE EXAMPLE 2

An image-receiving sheet for thermal dye-transfer recording was prepared in the same manner as in Example 8, except for additionally using 8 parts of natural ground calcium carbonate "Softon ® 1500" (a trade name, produced by Bihoku Funka K.K.; particle size: 4 μm).

REFERENCE EXAMPLE 3

An image-receiving sheet for thermal dye-transfer recording was prepared in the same manner as in Reference Example 1, except for additionally using 3.8 parts of a urea-formaldehyde condensate "Pergopak ® M2" (a trade name, produced by Ciba-Geigy AG; secondary particle size: 3 to 4 μm).

REFERENCE EXAMPLE 4

An image-receiving sheet for thermal dye-transfer recording was prepared in the same manner as in Reference Example 1, except for additionally using 3.8 parts of ethyl cellulose having a particle size of 6 μm as an organic pigment.

REFERENCE EXAMPLE 5

An image-receiving sheet for thermal dye-transfer recording was prepared in the same manner as in Reference Example 1, except for additionally using 10 parts of a styrene-vinyl acetate copolymer resin "Chemipearl ® V-100" (a trade name, produced by Mitsui Petrochemical Industries, Ltd.; concentration: 40.0%, particle size: 5 μm; softening point: 40° C.).

Each of the image-receiving sheets for thermal dye-transfer recording as obtained in Examples 8 to 10 and Reference Examples 1 to 5 was tested for quality as follows.

One part of a red heat-sublimable dye (Disperse Red 60), 1.5 parts of ethyl cellulose, 10 parts of isopropyl alcohol, and 5 parts of ethanol were mixed, pulverized, and dispersed in a sand mill to prepare a red dye ink having an average dispersed particle size of 1 μm.

The red dye inks were gravure printed on a non-treated surface of a 6 μm thick polyester film having been subjected to heat resistance-imparting treatment to a dry coverage of 1 g/m² to obtain a coloring material-transferring The coloring material-transferring sheet was superposed on the image-receiving sheet for thermal dye-transfer recording in such a manner that the coated sides of the sheets were in contact with each other. Heat was then applied from the back side of the coloring material-transferring sheet by means of a thermal head (applied voltage: 12 V; pulse width: 2 to 8 msec) to form a thermal dye-transferred image on the image-receiving sheet.

The density of the resulting image, fusion between the image-receiving sheet and the coloring material-transferring sheet during recording, heat bleeding of the recorded image, and the gloss of the recorded image were examined and evaluated as follows.

(a) Image Density:

The density of the image was measured by means of a Macbeth densitometer.

(b) Fusion:

The degree of fusion between the sheets on heat application during recording was evaluated.

(c) Heat Bleeding:

The recorded image was reserved at 60° C. for 48 hours, and the bleeding of the transferred dye was observed under a 25× magnifier.

(d) Gloss:

The gloss of the recorded image was measured by means of a glossmeter "GM-26D" (a trade name, manufactured by Murakami Shikisai Gijutsu Kenkyusho) at an angle of 75°.

The rating system for evaluating the heat fusion and heat bleeding is as follows. The results obtained are shown in Table 2 below.

TABLE 3

| Example No. | Fusion | Heat Bleeding | Gloss | Image Density 3.5 ms | 5.0 ms | 8.0 ms |
|---|---|---|---|---|---|---|
| Example 8 | A | A | 64.9 | 0.20 | 0.59 | 1.04 |
| Example 9 | A | A | 48.4 | 0.20 | 0.62 | 1.00 |
| Example 10 | A | A | 69.3 | 0.20 | 0.62 | 1.05 |
| Reference Example 1 | A | A | 95.2 | 0.20 | 0.62 | 1.07 |
| Example 2 | A | A | 68.1 | 0.13 | 0.52 | 0.95 |
| Example 3 | A | A | 29.9 | 0.09 | 0.26 | 0.90 |
| Example 4 | A | B | 42.1 | 0.13 | 0.47 | 0.91 |
| Example 5 | C | C | 42.3 | 0.12 | 0.40 | 0.97 |

Rating System:
A . . . Excellent
B . . . Medium
C . . . Poor

It can be seen from Table 3 that the image-receiving sheets for thermal dye-transfer recording which contain vinyl polymer fine particles have a matte surface while retaining excellent recording suitability and image quality.

While the invention has been described in detail and with reference to specific embodiments thereof, it will be apparent to one skilled in the art that various changes and modifications can be made therein without departing from the spirit and scope thereof.

What is claimed is:

1. An image-receiving sheet for thermal dye-transfer recording, which comprises a support having thereon an image-receiving layer for receiving a transferred image from a coloring material-transferring sheet, wherein said image-receiving layer is an image-receiving layer formed by coating an aqueous coating composition comprising a dyeable resin, an alcoholic hydroxyl group-containing alcohol-modified silicone oil, and colloidal silica and/or an aqueous crosslinking agent in an aqueous medium, followed by drying.

2. An image-receiving sheet as in claim 1, wherein said dyeable resin is a water-soluble or water-dispersible thermoplastic resin.

3. An image-receiving sheet as in claim 2, wherein said dyeable resin is a polyester, polystyrene, polyurethane, vinyl acetate copolymer, acrylic copolymer, epoxy resin, acetate resin, or nylon resin.

4. An image-receiving sheet as in claim 3, wherein said dyeable resin has a glass transition temperature of from 40° to 130° C.

5. An image-receiving sheet as in claim 4, wherein said dyeable resin has a glass transition temperature of from 60° to 110° C.

6. An image-receiving sheet as in claim 1, wherein said alcohol-modified silicone oil is represented by the following formula (1) or (2):

(1)

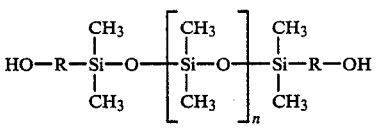

(2)

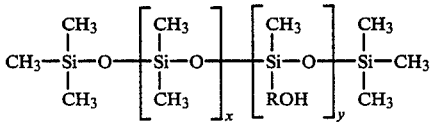

wherein R is an alkylene group containing from 1 to 10 carbon atoms; and n and the sum of x and y are each in the range of from 4 to 1,000.

7. An image-receiving sheet as in claim 6, wherein said alcohol-modified silicone oil has a molecular weight of from about 500 to 50,000.

8. An image-receiving sheet as in claim 1, wherein said alcohol-modified silicone oil is used in an amount of from 3 to 20% by weight based on the total solids content in said image-receiving layer.

9. An image-receiving sheet as in claim 8, wherein said alcohol-modified silicone oil is used in amount of from 5 to 15% by weight based on the total solids content in said image-receiving layer.

10. An image-receiving sheet as in claim 1, wherein said colloidal silica is an anhydrous silicate having a size of from 1 to 100 μm.

11. An image-receiving sheet as in claim 1, wherein said colloidal silica is used in an amount of from about 3 to 50% by weight based on the weight of said dyeable resin.

12. An image-receiving sheet as in claim 11, wherein said colloidal silica is used in an amount of from about 5 to 30% by weight based on the weight of said dyeable resin.

13. An image-receiving sheet as in claim 1, wherein said aqueous crosslinking agent is a water-soluble or water-dispersible crosslinking agent.

14. An image-receiving sheet as in claim 1, wherein said aqueous crosslinking agent is an aminoplast resin, a melamine resin, an epoxy resin, an aziridine resin, or an isocyanate resin.

15. An image-receiving sheet as in claim 1, wherein said aqueous crosslinking agent is used in an amount of from about 0.5 to 10% by weight based on the weight of said dyeable resin.

16. An image-receiving sheet as in claim 16, wherein said aqueous crosslinking agent is used in an amount of from about 1 to 5% by weight based on the weight of said dyeable resin.

17. An image-receiving sheet as in claim 1, wherein said image-receiving layer further contains dyeable vinyl polymer fine particles.

18. An image-receiving sheet as in claim 17, wherein said dyeable vinyl polymer fine particles are fine particles of a polymer comprising polystyrene as a main component.

19. An image-receiving sheet as in claim 17, wherein said dyeable vinyl polymer fine particles have a particle diameter of from 0.01 to 10 μm.

20. An image-receiving sheet as in claim 17, wherein said dyeable vinyl polymer fine particles are used in an amount of from about 5 to 30% by weight based on the weight of said dyeable resin.

* * * * *